US010455656B2

(12) United States Patent
Clout et al.

(10) Patent No.: US 10,455,656 B2
(45) Date of Patent: Oct. 22, 2019

(54) LIGHT OUTPOST POSITIONING

(71) Applicant: SIGNIFY HOLDING B.V., Eindhoven (NL)

(72) Inventors: Ramon Antoine Wiro Clout, Eindhoven (NL); Dirk Valentinus René Engelen, Heusden-Zolder (BE); Dzmitry Viktorovich Aliakseyeu, Eindhoven (NL); Bartel Marinus Van De Sluis, Eindhoven (NL); Jochen Renaat Van Gheluwe, Lommel (BE); Philip Steven Newton, Waalre (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/080,332

(22) PCT Filed: Feb. 22, 2017

(86) PCT No.: PCT/EP2017/005048
§ 371 (c)(1),
(2) Date: Aug. 28, 2018

(87) PCT Pub. No.: WO2017/148768
PCT Pub. Date: Sep. 8, 2017

(65) Prior Publication Data

US 2019/0029088 A1 Jan. 24, 2019

(30) Foreign Application Priority Data

Mar. 3, 2016 (EP) ..... 16158373

(51) Int. Cl.
*H05B 33/08* (2006.01)
*H05B 37/02* (2006.01)
*F21V 23/04* (2006.01)

(52) U.S. Cl.
CPC ..... *H05B 33/0842* (2013.01); *F21V 23/0435* (2013.01); *H05B 33/0863* (2013.01); *H05B 37/0272* (2013.01)

(58) Field of Classification Search
CPC .. H05B 33/08; H05B 33/0842; H05B 33/086; H05B 33/0863; H05B 37/02;
(Continued)

(56) References Cited

U.S. PATENT DOCUMENTS

2012/0068857 A1* 3/2012 Rothkopf ..... G08C 19/28 340/870.07
2015/0022123 A1* 1/2015 Van De Sluis .... H05B 37/0245 315/312
(Continued)

FOREIGN PATENT DOCUMENTS

WO 2012113036 A1 8/2012
WO 2014181205 A2 11/2014
(Continued)

*Primary Examiner* — Thai Pham
(74) *Attorney, Agent, or Firm* — Akarsh P. Belagodu

(57) ABSTRACT

A method (200, 300) of controlling a luminaire (50) adapted to generate a light output (60) in a controllable direction with a user interface device (10) is disclosed. The method comprises determining (207) a relative orientation of the user interface device to the luminaire; receiving (219) a light output positioning instruction on a user interface (20) of the user interface device, said light output positioning instruction including directional information for the positioning of the light output in a specified location; converting (221) the light output positioning instruction by transforming the directional information based on the determined relative orientation; and transmitting (223) the converted light output positioning instruction to the luminaire. A computer program product, user interface device and lighting system employing this method are also disclosed.

14 Claims, 9 Drawing Sheets

(58) Field of Classification Search
CPC . H05B 37/0245; H05B 37/0272; F21V 23/04; F21V 23/0435
See application file for complete search history.

(56) References Cited

U.S. PATENT DOCUMENTS

| | | | | |
|---|---|---|---|---|
| 2015/0084514 | A1* | 3/2015 | Anthony | H05B 33/0863 315/131 |
| 2015/0276399 | A1 | 10/2015 | Breuer et al. | |
| 2016/0120009 | A1* | 4/2016 | Aliakseyeu et al. | H05B 37/0272 315/131 |

FOREIGN PATENT DOCUMENTS

| | | | |
|---|---|---|---|
| WO | 2015009148 | A1 | 1/2015 |
| WO | 2015113824 | A1 | 8/2015 |
| WO | 2015114123 | A1 | 8/2015 |

* cited by examiner

200

LIGHT OUTPOST POSITIONING

CROSS-REFERENCE TO PRIOR APPLICATIONS

This application is the U.S. National Phase application under 35 U.S.C. § 371 of International Application No. PCT/EP2017/054048, filed on Feb. 22, 2017, which claims the benefit of European Patent Application No. 16158373.7, filed on Mar. 3, 2016. These applications are hereby incorporated by reference herein.

FIELD OF THE INVENTION

The present invention relates to a method of controlling a luminaire adapted to generate a light output in a controllable direction with a user interface device.

The present invention further relates to a computer program product for implementing such a method on a user interface device.

The present invention yet further relates to a user interface device adapted to implement such a method.

The present invention even further relates to a lighting arrangement including such a user interface device and a luminaire adapted to generate a light output in a controllable direction.

BACKGROUND OF THE INVENTION

With the advent of solid state lighting solutions, e.g. LEDs, a trend towards generating dynamic lighting effects has emerged in order to increase the appeal of such lighting effects. For example, WO 2012/113036 A1 discloses a system for providing illumination. The system comprises a source of electromagnetic radiation, a user interface that is able to be moved such that a position of the user interface is able to be specified by a value of at least one coordinate of a coordinate system, wherein each coordinate of the coordinate system is associated with a respective property of electromagnetic radiation outputted from the source and a controller for controlling each property of the electromagnetic radiation according to the position of the interface. The user interface comprises a hollow sphere formed of a transmissive and an opaque hemisphere. By rolling the hollow sphere over an array of LEDs, the area of the transmissive hemisphere through which light can escape can be configured relative to the array, thereby creating a dynamic light effect.

Another type of luminaire capable of producing a configurable (dynamic) lighting effect is a spotlight, i.e. a luminaire adapted to project a shaped bundle of light, i.e. a light output such as one or more light spots or an image, onto a chosen location, e.g. a wall, floor or ceiling surface region to highlight the chosen region. Embodiments of such luminaires capable of altering the location of such a light output in response to a user instruction are known per se. For example, such luminaires may comprise mechanically adjustable optical guiding members, e.g. actuated mirrors, lenses or the like, to change the location of the light output in response to such a user instruction, or may comprise an array of individually addressable solid state lighting (SSL) elements arranged to direct their luminous output in different directions, e.g. by guiding the luminous outputs of the respective SSL elements through one or more optical elements, e.g. collimators, lenses or the like, such that a light output in a particular location may be created by enabling the subset of the SSL elements arranged to direct their luminous outputs at the particular location.

Such luminaires facilitate the creation of dynamic user light effects, for example by a user specifying on a user interface device in communication with the luminaire how the light output should be redirected from its current location to a new location. In this manner, the user for example may wish to highlight another feature, e.g. a new feature such as a decoration, painting or the like, and redirect the light output to this new feature. For example, as schematically depicted in FIG. 1, a user may use a user interface device 10, e.g. a portable device comprising a user interface 20 such as a touchscreen, which user interface device may be controlled through a master button 11 and may further include a camera 15 amongst other components as is well-known per se. The user interface device 20 may be adapted to execute a program such as an app designed to direct the location of a light output 60 produced by a controllable luminaire to or across a surface region 61, for example by moving an icon 21 or the like on the user interface 20 in a direction indicative of the desired direction in which the light output 60 should be repositioned, e.g. by swiping or the like, with the icon 21 represents a current location of the light output 60.

Patent applictaion US 20150084514 A1 relates to techniques and user interfaces for controlling a solid-state luminaire having an electronically adjustable light beam distribution. The user interface may be configured, in accordance with some embodiments, to provide a user with the ability to control, by wireless and/or wired connection, the light distribution of an associated solid-state luminaire in a given space. The user interface device may include a position and/or motion sensor configured to aid in determining the orientation and/or movement of the device with respect to the luminaire.

SUMMARY OF THE INVENTION

A problem commonly encountered with such user interface devices is that the direction in which the icon 21 is moved does not correspond to the direction in which the light output 60 is moved by the luminaire receiving the light output position adjustment instruction corresponding to the directional information provided by the user to the user interface device 10 through its user interface 20, as indicated by the block arrows in FIG. 1. For example, the luminaire may be seen by the user to change the position of the light output 60 in a direction that appears to be rotated relative to the direction indicated by the user and/or that appears to be mirrored relative to the direction indicated by the user, which is indicative of a mirror axis being present between the luminaire and the user interface device. This makes repositioning the light output 60 to a desired location rather cumbersome, as the user has to figure out how to relate the light output the location direction provided to the user interface 20 to the actual light output relocation direction generated by the luminaire in response to the relocation instruction received from the user interface device. This therefore leads to an unsatisfactory user experience.

The present invention seeks to provide a method of controlling a luminaire adapted to generate a light output in a controllable direction with a user interface device in a more intuitive manner.

The present invention further seeks to provide a computer program product that facilitates the implementation of this method on a user interface device.

The present invention yet further seeks to provide a user interface device adapted to implement this method by comprising such a computer program product.

The present invention still further seeks to provide a lighting arrangement comprising such a user interface device and a luminaire arrangement including a luminaire adapted to generate a light output in a controllable direction and being responsive to the user interface device.

According to an aspect, there is provided a method of controlling a luminaire adapted to generate a light output in a controllable direction with a user interface device, the method comprising determining a relative orientation of the user interface device to the luminaire; receiving a light output positioning instruction on a user interface of the user interface device, said light output positioning instruction including directional information for the positioning of the light output in a specified location; converting the light output positioning instruction by transforming the directional information based on the determined relative orientation; and transmitting the converted light output positioning instruction to the luminaire.

Embodiments of the present invention are based on the insight that by determining the relative orientation of the user interface device in respect of the luminaire, e.g. the direction in which the luminaire generates a light output, may be used to transform the directional information in the user instruction for positioning the light output in a desired location, e.g. using a transformation matrix derived from the relative orientation, such that the direction in which the user indicates the positioning of the light output more closely corresponds to the direction in which the luminaire positions the light output, thereby providing a more intuitive user experience for a user using a user interface device implementing this method.

In an embodiment, determining a relative orientation of the user interface device to the luminaire comprises determining a rotation angle of the user interface device relative to the luminaire and the existence of a mirroring axis between the user interface device and the luminaire; and the directional information is transformed based on the determined rotation angle and mirroring axis if existing. For example, the method may comprise the generation of a transformation matrix based on the determined rotation angle and mirroring axis if present, which transformation matrix may be used to transform the directional information present in the user instruction into a transformed user instruction to be sent to the luminaire, such that the direction in which the luminaire positions (orients) the light output closely resembles the user-intended direction of the light output positioning.

In an embodiment, determining the existence of a mirroring axis between the user interface device and the luminaire comprises receiving an indication of said existence on the user interface. For example, the user interface may comprise a toggle function that can be toggled between a true state in which the existence of such a mirroring axis is confirmed and a false state in which the existence of such a mirroring axis is denied. The user for example may be able to provide such information in a calibration mode, in which the user may provide the luminaire with one or more calibration instructions from which the user can determine if the response of the luminaire to the user instructions is indicative of the existence of such a mirroring axis.

The relative orientation between the user interface device and luminaire may be obtained in any suitable manner. For example, the method may comprise receiving luminaire orientation information from the luminaire, wherein determining a relative orientation of the user interface device to the luminaire is at least partially based on the received luminaire orientation information. To this end, the luminaire may comprise one or more orientation sensors that facilitate the provisioning of the luminaire orientation information.

The method may further comprise determining a user interface device orientation, wherein determining a relative orientation of the user interface device to the luminaire is at least partially based on the determined user interface device orientation. To this end, the user interface device may comprise one or more orientation sensors that facilitate the provisioning of the user interface device orientation. In an embodiment in which the luminaire orientation information as well as the user interface device orientation is provided, the orientation of the user interface device relative to the luminaire may simply be derived from these respective orientations, in which case it may only be necessary to separately determine if a mirroring axis exists between the user interface device and a luminaire, as this determination may not be derivable from the respective orientations of the user interface device and the luminaire.

However, it is not necessary for the luminaire to provide information regarding its orientation, i.e. the luminaire does not need to comprise one or more orientation sensors. In an alternative embodiment, determining a relative orientation of the user interface device to the luminaire comprises instructing the luminaire to redirect the light output in a reference direction; capturing an observation direction of the light output redirection with the user interface device; and determining the relative orientation of the user interface device to the luminaire from a difference between the reference direction and the observation direction. In this manner, the relative orientation of the user interface device in respect of the luminaire may be determined without the need for one or more orientation sensors in either the user interface device or the luminaire.

For example, instructing the luminaire to redirect the light output in a reference direction may comprise receiving the reference direction on the user interface, e.g. by a user providing the reference direction through the user interface. Alternatively, the reference direction may be a predefined direction, which predefined direction may be defined relative to the actual orientation of the user interface device. In the latter scenario, instructing the luminaire to redirect the light output in a reference direction may comprise instruction the luminaire to generate a series of light outputs in different locations in said reference direction without requiring a user-specified reference direction.

Capturing an observation direction of the light output redirection with the user interface device may comprise receiving an indication of the observation direction on the user interface, for instance by a user specifying the observation direction on the user interface. Alternatively, the observation direction may be captured with a camera integral to the user interface device.

In an embodiment, determining a relative orientation of the user interface device to the luminaire is at least partially based on an initially determined user interface device orientation, the method further comprising monitoring the user interface device orientation; and updating the relative orientation based on a monitored change to the initially determined user interface device orientation. This is particularly relevant to the user interface devices comprising one or more orientation sensors as the one or more orientation sensors may be used to associate the initial orientation with the determination of the relative orientation of the user interface device in respect of the luminaire, such that monitored changes to the initial orientation may be used to update the relative orientation of the user interface device in respect of the luminaire, e.g. update a transformation matrix based on the initially determined relative orientation, without having to recalibrate the user interface device. This is particularly useful if the user interface is a portable user interface device such as a smart phone or tablet computer, as a user of such a portable user interface device is likely to move around with such a device, i.e. is likely to change the relative orientation of the device in respect of the luminaire.

The method may further comprise determining a distance between the user interface device and the luminaire, wherein converting the light output positioning instruction further comprises scaling the directional information based on the determined distance. In this manner, the granularity or responsiveness of the user interface of the user interface device may be adjusted as a function of the distance of the user from the light output; for example, at a large distance the user may perceive the distance between the current location of a light output and the desired location of the light output as much smaller than when being close to the light output. Therefore, at a large distance from the light output the user may want to make a smaller movement on the user interface compared to the user being at a smaller distance from the light output whilst the actual displacement distance of the light output remains the same, which can be achieved by scaling the user instruction based on the obtained distance information. Such distance information may be obtained in any suitable manner, e.g. using time of flight measurements, signal strength measurements or the like.

The method may further comprise determining a tilt angle of the luminaire relative to a surface onto which the light output is projected, wherein converting the light output positioning instruction further comprises scaling the directional information based on the determined tilt angle. Such a tilt angle for example may be determined by user calibration and has the advantage that such scaling based on the tilt angle information can ensure that repositioning of a light output projected under an angle onto a surface such as a wall can be performed in a uniform manner, i.e. resulting in equal movements of the light output regardless of the direction in which the light output is repositioned. Such a tilt angle information may further be used to provide the luminaire with spot size adjustment information in the light output positioning instruction, which spot size adjustment information is a function of the direction in which the light output is intended to be oriented, e.g. repositioned; for example, where such an (re)orientation direction increases the tilt angle, the spot size adjustment information may cause the luminaire to reduce the size of the light output produced in order for the project light output to maintain its original size.

According to another aspect, there is provided a computer program product comprising a computer readable storage medium having computer readable program instructions embodied therewith for, when executed on a processor of a user interface device for controlling a luminaire adapted to generate a light output in a controllable direction, cause the processor to implement the method of any of the embodiments described in this application. Such a computer program product for example may facilitate the installation of computer program code comprising the computer readable program instructions on any device suitable to operate as a user interface device for controlling a luminaire adapted to generate a light output in a controllable direction, e.g. a dedicated user interface device or a general purpose computing device such as a personal computer, laptop computer, tablet computer, personal digital assistant, mobile phone, e.g. a smart phone, and so on.

According to yet another aspect, there is provided a user interface device for controlling a luminaire adapted to generate a light output in a controllable direction, the user interface device comprising a processor communicatively coupled to a user interface; a data storage device embodying the computer program product according to any embodiment as described in this application and a wireless communication module, wherein the processor is adapted to execute the computer readable program instructions of the computer program product and to send a light output positioning instruction received on the user interface to the luminaire with the wireless communication module. Such a user interface device, e.g. a dedicated user interface device or a general purpose computing device such as a personal computer, laptop computer, tablet computer, personal digital assistant, mobile phone, e.g. a smart phone, and so on, facilitates an intuitive user experience when controlling the light output position generated with the luminaire.

According to still another aspect, there is provided an illumination system comprising the user interface device according to any embodiment described in the present application and a luminaire arrangement including a luminaire adapted to generate a light output in a controllable direction, a controller for controlling the luminaire and a further wireless communication module adapted to receive a light output positioning instruction from the user interface and communicate the received light output positioning instruction to the controller. Such an illumination system may be controlled in an intuitive manner, as explained above.

In the context of the present invention, the (existence of the) mirroring axis is indicative of that the user interface is mirrored relative to the luminaire. Thus, if a mirroring axis is existing, when a user would want to control the direction of the light output leftwards and provide a 'leftward' user input on the user interface, the direction of the light output of the luminaire would move rightwards.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
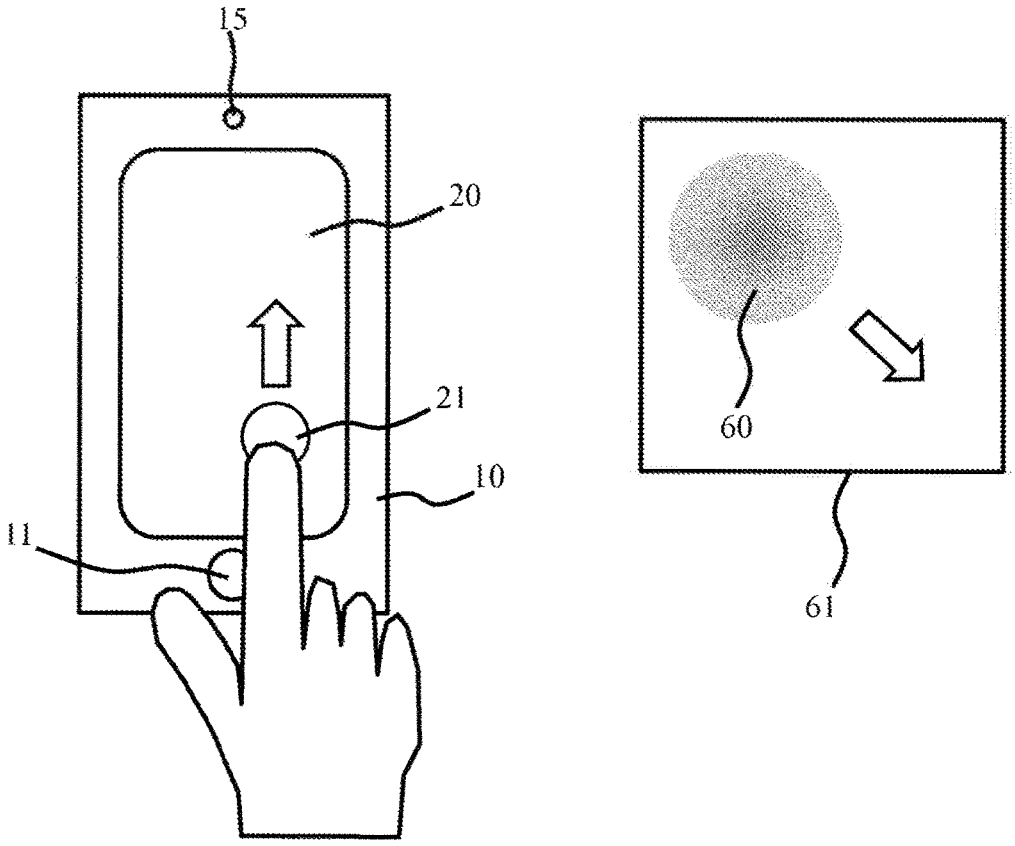
FIG. 1 PRIOR ART
FIG. 1 schematically depicts a typical user experience when controlling a luminaire adapted to generate a light output in a controllable direction with a prior art user interface device.

It should be understood that the Figures are merely schematic and are not drawn to scale. It should also be understood that the same reference numerals are used throughout the Figures to indicate the same or similar parts.

In the context of the present application, where reference is made to the orientation of a luminaire, this may mean the orientation from which the luminaire generates a light output onto a surface in a particular direction. For example, such an orientation may be defined in terms of a light exit surface of the luminaire, such that the direction in which a spot is generated may be derived from orientation information indicative of the luminaire orientation. The orientation of a luminaire may be defined in terms of an orientation in any suitable coordinate system, and may be defined in terms of an orientation relative to the Earth's magnetic poles or as a rotational orientation about a nadir axis. In some embodiments, the luminaire orientation may be further devices in terms of luminaire pitch, in which pitch generally references the rotation of the luminaire about a second axis perpendicular to the nadir axis and in terms of luminaire roll, in which roll generally references the rotation of the luminaire about a third axis perpendicular to the nadir axis and the second axis.

In the context of the present application, where reference is made to the orientation of a user interface device, this may mean the orientation of the user interface of such a user interface device, e.g. a touchscreen orientation. The orientation of a user interface device may be defined in terms of an orientation in any suitable coordinate system, and may be defined in terms of an orientation relative to the Earth's magnetic poles or as a rotational orientation about a nadir axis. In some embodiments, the user interface device orientation may be further devices in terms of user interface device pitch, in which pitch generally references the rotation of the user interface device about a second axis perpendicular to the nadir axis and in terms of user interface device roll, in which roll generally references the rotation of the user interface device about a third axis perpendicular to the nadir axis and the second axis.

In the context of the present application, where reference is made to a light output, this refers to a light shape or pattern of light shapes that can be projected on one or more surfaces to illuminate a part of the one or more surfaces. For example, the light output may be a light spot having any suitable shape, e.g. a circular light spot, oval light spot, polygonal light spot, freeform light spot, any combination of such light spots, e.g. a pattern of shapes like stars, rectangles, and so on, or an image, e.g. an image comprising different dimming values for different coordinates of the light output, etcetera.

Figure 2:
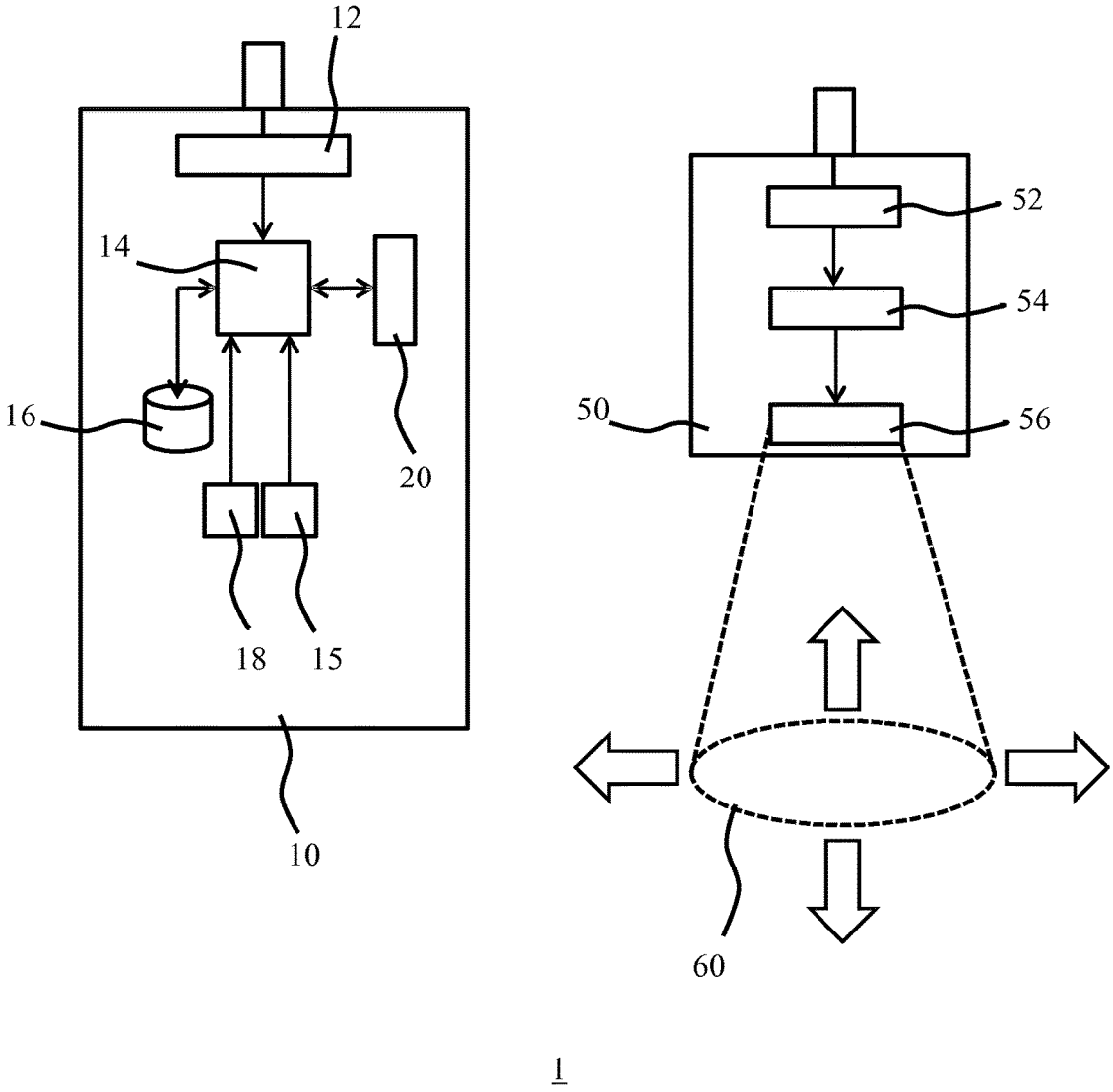
FIG. 2 schematically depicts an illumination system according to an embodiment.

FIG. 2 schematically depicts an example embodiment of an illumination system 1 including a user interface device 10 and a luminaire 50 under control of the user interface device 10. For the avoidance of doubt, it is pointed out that a user interface device 10 adapted to control the luminaire 50 does not necessarily form part of the illumination system 1, i.e. may be provided as a stand-alone device. Moreover, as will be explained in further detail below, such a user interface device 10 may be a device that is known per se but that is configured with a computer program product according to an embodiment of the present invention, which computer program product may be provided as a stand-alone product, e.g. in a form of a software programme such as an app, which may be obtained in any suitable manner, e.g. on a physical carrier or by downloading it from a software repository such as an app store.

The user interface device 10 typically comprises a wireless communication module 12, e.g. a wireless transceiver, for communicating with the luminaire 50. The wireless communication module 12 may employ any suitable wireless communication protocol, e.g. Bluetooth, Wi-Fi, infrared, a mobile communication protocol such as 2G, 3G, 4G or 5G, a suitable near-field communication (NFC) protocol, and so on or may employ a proprietary protocol. The user interface 10 further comprises a processor 14, which may have any suitable processor architecture. For example, the processor 14 may be a generic processor, an application-specific processor (ASIC), a microprocessor, and so on. The user interface device 10 may comprise one or more of such processors 14; for the sake of brevity only, reference will be made in the remainder of this application to a processor 14, and it should be understood that this means one or more processors 14.

The user interface device 10 further comprises a data storage device 16 communicatively coupled to the processor 14. Such a data storage device 16 may include one or more of RAM, ROM, Flash memory, a magnetic disk, an optical disc, a solid state storage device, and so on.

The user interface device 10 further comprises a user interface 20, which may be a touchscreen in some embodiments although embodiments of the present invention are not limited thereto; it is for instance equally feasible that the user interface 20 is at least partially implemented by one or more physical switches, knobs, dials or the like. The user interface 20 is typically communicatively coupled to the processor 14, e.g. may be controlled by the processor 14 in case of a touchscreen and is typically arranged to allow a user to provide control instructions for the luminaire 50 to the processor 14, with the processor 14 adapted to process these instructions and transmit them to the luminaire 50 through wireless communication module 12.

The user interface device 10 may further comprise optional additional components, such as a camera 15, which may be mounted within the user interface device 10 in any suitable location, e.g. in a front panel of the user interface device 10, i.e. a panel facing the user, or in a back panel of the user interface device 10, i.e. a panel opposite the front panel. The user interface device 10 may comprise more than one camera 15, e.g. a first camera 15 in the front panel and a second camera 15 in the back panel. The presence of a camera 15 in the back panel is specifically mentioned because it allows a user to operate the user interface device 10 whilst at the same time capturing a light spot 60 generated with the luminaire 50, as will be explained in more detail below. The one or more cameras 15 may be communicatively coupled to the processor 14, with the processor 14 adapted to process image data generated by the one or more cameras 15, as is well-known per se and therefore will not be explained in further detail for the sake of brevity only.

The user interface device 10 may further comprise one or more sensors 18 for determining an orientation of the user interface device 10. For example, the one or more sensors 18 may comprise one or more accelerometers, gyroscopes, Hall effect sensors and so on to capture orientation data of the user interface device 10, e.g. the orientation of the user interface device 10 relative to the Earth's magnetic field with a Hall effect sensor. The one or more sensors 18 may be communicatively coupled to the processor 14, with the processor 14 arranged to determine the orientation of the user interface device 10 from the sensor data generated by the one or more sensors 18. As such orientation detection and the sensors used in such orientation detection is well-known per se, this will not be explained in more detail for the sake of brevity only.

The luminaire 50 may be a stand-alone luminaire or may form part of a lighting system including one or more luminaires. A wireless communication module 52 is present in the luminaire 50 or the lighting system of which the luminaire 50 forms a part, which wireless communication module 52 is adapted to communicate with the wireless communication module 12 of the user interface device 10 using any suitable wireless communication protocol, e.g. any of the wireless communication protocols described above. Where the wireless communication module 52 is external to the luminaire 50, the wireless communication module 52 may be a wireless bridge or the like that acts as a central wireless communication point for the one or more luminaires in the lighting system.

The luminaire 50 may further comprise a controller 54 and a light engine arrangement 56 under control of the controller 54. The controller 54 is communicatively coupled to the wireless communication module 52 and is adapted to control the light engine arrangement 56 in response to a user instruction received from the user interface device 10 via the wireless communication module 52. Any suitable controller design may be contemplated for the controller 54. The light engine arrangement 56 may include one or more light sources, e.g. one or more SSL elements such as LEDs, which may be individually controllable by the controller 54. The light engine arrangement 56 may further comprise one or more optical elements arranged to direct the luminous output of a particular light source or group of light sources of the light engine arrangement 56 into a particular direction, with different optical elements directing such luminous outputs in different directions. In this manner, the controller 54 can adjust the position of a light output 60 projected onto a surface such as a wall, floor, ceiling or the like as indicated by the block arrows by switching on those light sources that are arranged to direct their luminous output onto the intended position of the light output. Alternatively, the luminaire 50 may comprise mechanically movable optical parts, e.g. mechanically movable mirrors, lenses or the like, under control of the controller 54, such that the light output 60 may be redirected by the controller by moving the mechanically movable optical parts into the appropriate orientation.

It is emphasized that such configurable spotlight luminaires, i.e. luminaires that can be controlled to generate a light output 60 in a controllable direction are well-known per se, and that the above embodiments of such a luminaire 50 have been described by way of non-limiting examples only; it should be understood that any suitable embodiment of such well-known luminaires may be contemplated.

The luminaire 50 may further comprise one or more sensors (not shown) for determining an orientation of the luminaire 50. For example, the one or more sensors may comprise one or more accelerometers, gyroscopes, Hall effect sensors and so on to capture orientation data of the luminaire 50, e.g. the orientation of the luminaire 50 relative to the Earth's magnetic field with a Hall effect sensor. The one or more sensors 18 may be communicatively coupled to a processor within the luminaire 50, with the processor arranged to determine the orientation of the luminaire 50 from the sensor data generated by the one or more sensors. For example, such a processor may be embodied by the controller 54 or may be a separate processor. Alternatively, the sensor data may be transmitted to the user interface device 10 with the wireless communication module 52 for processing by the processor 14.

As will be appreciated, the light output 60 may be positioned by the luminaire 50 in a multitude of positions and in a multitude of orientations, i.e. the luminaire 50 may generate the light output 60 in a controllable direction. In order for a user of the user interface device 10 to be able to intuitively control the luminaire 50, or more specifically the position of the light output 60 generated by the luminaire 50, the relative orientation of the user interface device 10 respective to the luminaire 50 must be known such that a user instruction for moving the light output 60 to a new location can be translated into a corresponding movement of the light output 60. At least some embodiments of the present invention are based on the insight that movement of such a light output across a surface may be approximated as a two dimensional motion, such that the relative orientation of the user interface device 10 in respect of the luminaire 50 may be expressed by two parameters, namely a rotation $\theta$, i.e. the rotation of a direction of light output translation specified by a user with the user interface device 10 relative to the actual direction of light output translation generated by the luminaire 50, and a Boolean indicating the existence of a mirroring axis between the user-specified light output translation direction and the actual light output translation direction as generated by the luminaire 50.

The determination of these parameters facilitate the generation of a transformation (rotation) matrix that can be used to transform the user-specified light output translation direction and provide the luminaire 50 with this transformed light output translation instruction, such that the actual light output translation generated with the luminaire 50 more closely (accurately) resembles the light outputs translation direction indicated by the user on the user interface 20 of the user interface device 10.

Figure 3:
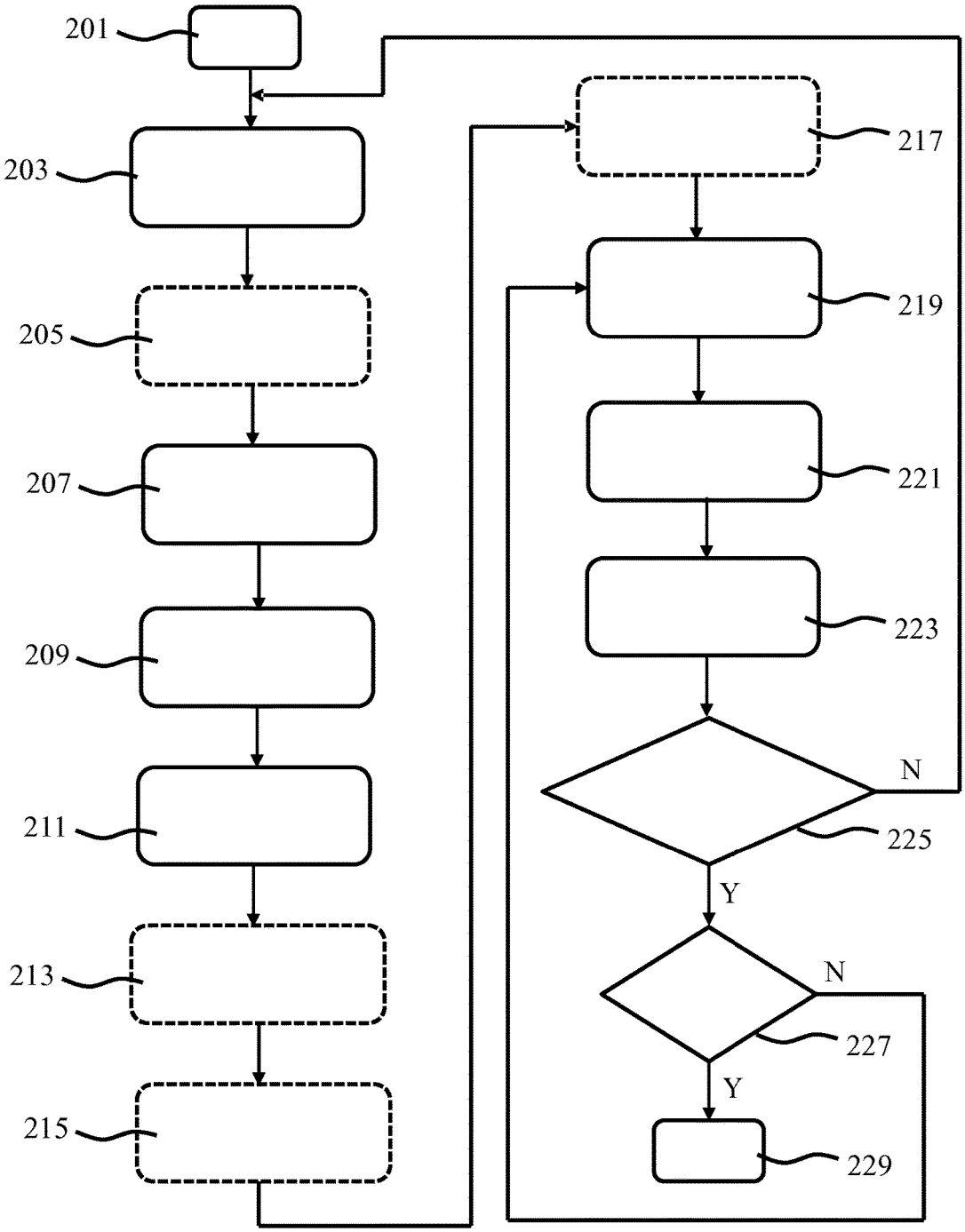
FIG. 3 is a flowchart of a luminaire control method according to an embodiment.
Figure 4:
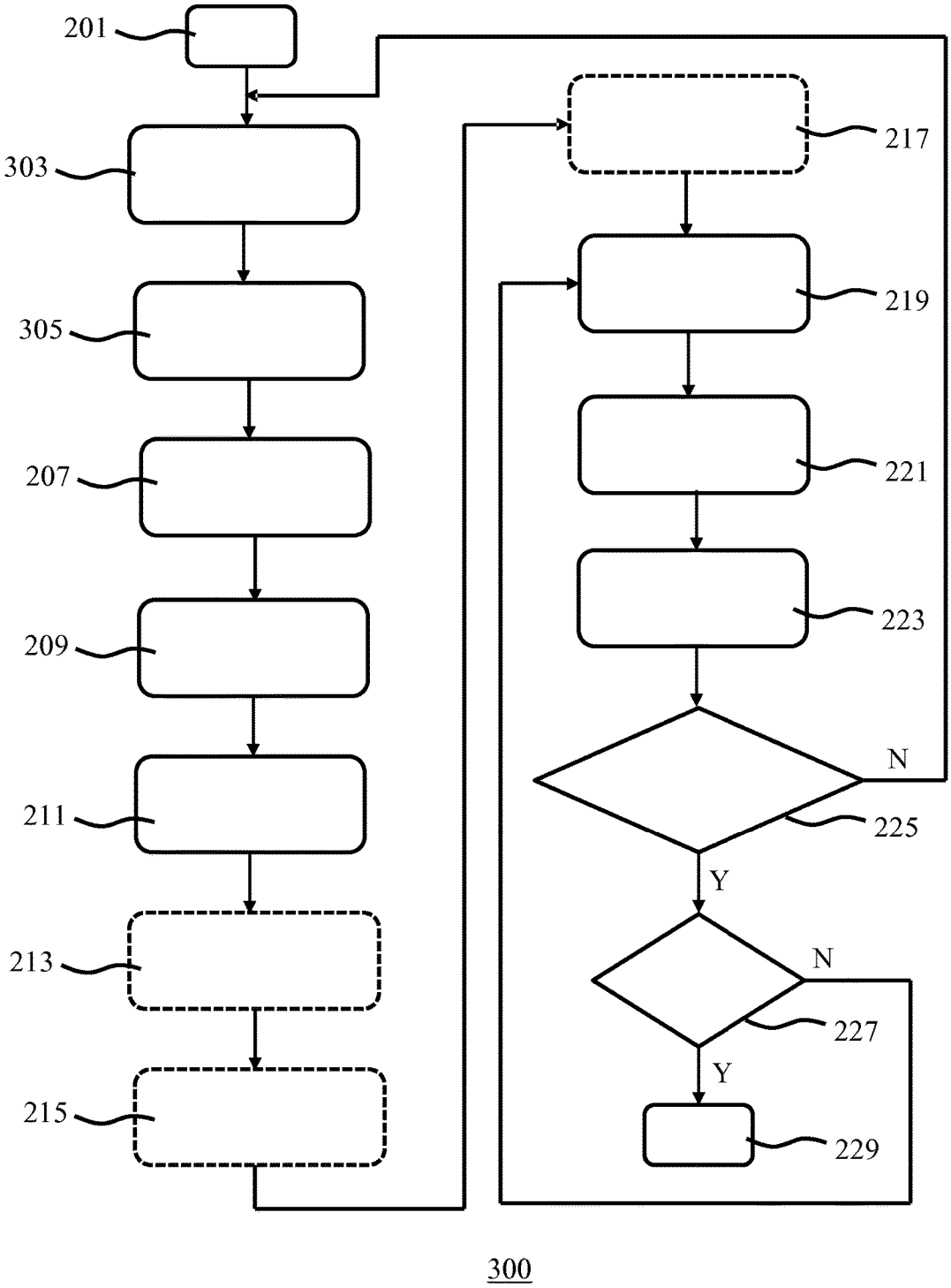
FIG. 4 is a flowchart of a luminaire control method according to another embodiment.

FIG. 3 schematically depicts an embodiment of a method 200 of controlling the luminaire 50 with the user interface device 10 and FIG. 4 schematically depicts an embodiment of a method 300 of controlling the luminaire 50 with the user interface device 10 in which this principle is applied. Because both methods 200 and 300 share many operational steps, they will be described together below. In the flowcharts, optional steps are indicated by dashed boxes. However, it is noted for the avoidance of doubt that where certain operation steps are depicted by solid boxes in these flow charts, this does not imply that these operational steps are necessarily essential.

The methods 200 and 300 each start in 201, for example by switching on the user interface device 10 and luminaire 50, and optionally establishing a wireless communication link between the wireless communication module 12 of the user interface device 10 and the wireless communication module 52 of the luminaire 50, although this may alternatively be achieved whenever a communication between the user interface device 10 and the luminaire.

Next, both methods 200 and 300 progress to implement operational steps from which the relative orientation of the user interface device 10 respective of the luminaire 50 may be derived or assumed. In method 200, this for example may be achieved by determining the luminaire orientation in 203, e.g. with the previously explained orientation sensor arrangement in the luminaire 50, and providing the user interface device 10 with the determined luminaire orientation information, e.g. via a wireless communication between wireless communication modules 12 and 52. In 205, the user interface device orientation may be determined, e.g. with the previously explained orientation sensor arrangement 18 in the user interface device 10, after which the relative orientation of the user interface device 10 in respect of the luminaire 50 may be derived in 207 from the received luminaire orientation information and the determined user interface device orientation.

At this point, it is noted that where the user interface device 10 is adapted to change the location of a light output 60 in a vertical direction only, it may suffice to only obtain the orientation information of the luminaire 50, e.g. the orientation of the luminaire 50 relative to a vertical plane such as a wall, in particular tilt angle information, as from this orientation information the processor 14 can associate user-specified movement of the light output 60 on the user interface 20 with the vertical movement of the light output 60 along this vertical plane. However, for the avoidance of doubt it is noted that preferably both the luminaire orientation information and user interface device orientation is determined such that the relative orientation determination of the user interface device 10 in respect of the luminaire 50 may be used to implement intuitive control of the light output 60 in multiple directions.

Method 300 covers embodiments in which at least the luminaire 50 may be incapable of providing luminaire orientation information, e.g. because the luminaire 50 does not contain orientation sensors. In these embodiments, the relative orientation of the user interface device 10 in respect of the luminaire 50 may be determined by generating a user-specified or automated reference instruction in 303, which reference instruction includes directional information indicating the direction in which the luminaire 50 should move the light output 60 and capturing a user-specified or optical observation in 305 of the actual direction in which the luminaire 50 has moved the light output 60 in response to this reference instruction as perceived by the user of the user interface device 10, e.g. by the user specifying the perceived direction on the user interface 20 or by the camera 15 capturing this actual direction, such that the processor 14 can calculate the angle θ between the direction specified in the reference instruction and the perceived direction in which the luminaire 50 has moved the light output 60 in 207 from the directional information in the reference instruction and the perceived direction in which the luminaire 50 has moved the light output 60 as specified by the user on the user interface 20 or as captured by the camera 15 by observing the light output 60 and its repositioning by the luminaire 50. In the latter scenario, the processor 14 may employ image recognition techniques to derive the perceived direction from the path along which light output 60 has moved. As such image recognition algorithms are well-known per se, they are not explained in further detail for the sake of brevity only.

Figure 5:
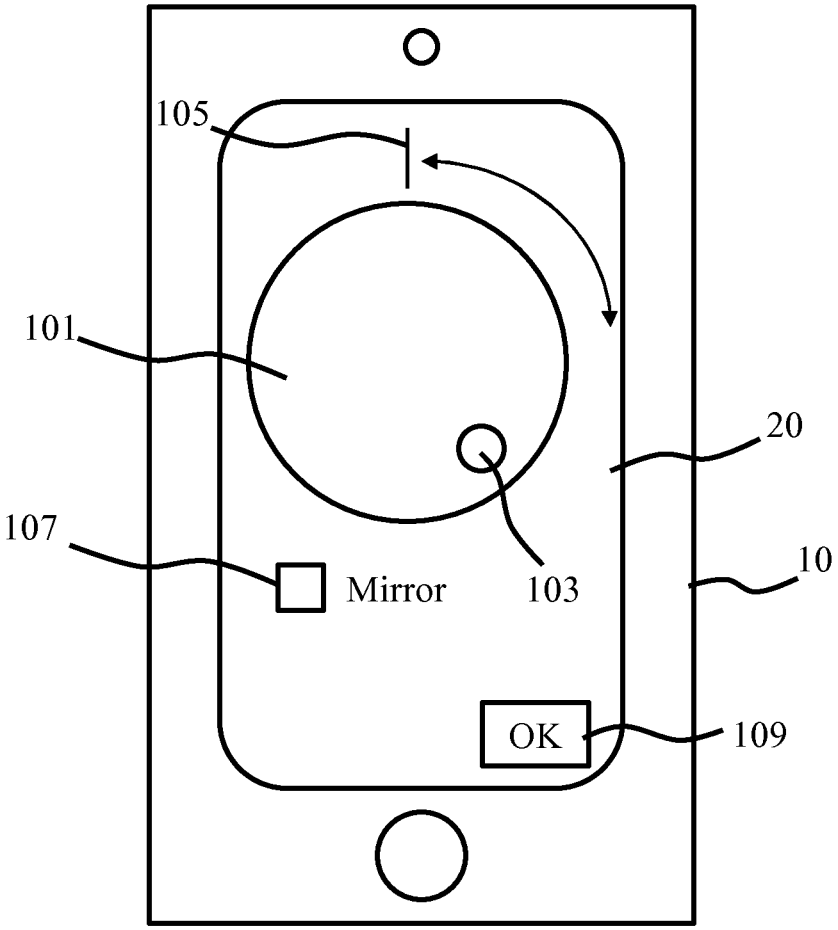
FIG. 5 schematically depicts an example of a user interface for establishing the relative orientation of the user interface device according to an embodiment.

FIG. 5 schematically depicts an example embodiment of a user interface control of the user interface 10 allowing a user to specify a translation of the light output 60 by the luminaire 50 and register a perceived trajectory of this translation. The user interface control in this embodiment is shaped as a dial 101 that may be rotated by the user to indicate a rotation direction of the light output 60. The dial 101 may include a reference 103 that defines an angle α relative to a further reference 105, which further reference 105 typically is located in an intuitive orientation point of the user interface 20, e.g. at the top or bottom of the user interface 20. The further reference 105 may be a visible reference, e.g. a marker or the like on the user interface 20 although this is not necessary; the user may be made aware in any suitable manner of the existence of this further reference 105.

The further reference 105 is intended to correspond to an extreme location of the light output 60 in the light output relocation operation performed with the luminaire 50, e.g. a light output furthest away from the user, a light output at a highest or lowest point in a trajectory invoked by the luminaire 50, and so on. The user may rotate the dial 101 to find the perceived extreme location and provide an indication when this perceived extreme location is found, e.g. by activating a designated switch such as the OK button 109. Upon receiving this indication, the processor 14 may determine the position of the reference 103 at the point of the user providing this indication and the angle α between the reference 103 in this position and the further reference 105.

In an embodiment, the luminaire 50 may be adapted to create a reference luminous profile in addition to the light output 60 to aid the user in determining the perceived extreme location of the light output 60. For example, the luminaire 50 may be adapted to create a central light beam acting as an optical axis around which the light output 60 is rotated or for example may be adapted to create a reference object having a particular shape, which shape may assist the user in identifying this perceived extreme position.

In addition, the user interface 20 may allow the user to specify whether a mirroring axis is present between the user interface device 10 and the luminaire 50, with the presence of such a mirroring axis for example being evident to the user if a clockwise rotation of the light output 60 as indicated with the dial 101 is translated by the luminaire 50 into a counter-clockwise rotation or vice versa. This indication may be made by the user in any suitable manner, for example by the provision of a designated tick box 107 or a similar user interface control that may be seen to specify the true or false value for the Boolean "There is a Mirroring Axis". Methods 200 and 300 may check the value of this Boolean in 209 before constructing a transformation matrix (here a rotation matrix) in 211. Such a rotation matrix R may be defined as follows:

$$R = \begin{bmatrix} \cos(\alpha) & -\sin(\alpha) \\ \sin(\alpha) & \cos(\alpha) \end{bmatrix}.$$

This rotation matrix may be used to translate screen coordinates (x, y) to spot coordinates ($x_s$, $y_s$) in the following way:

$$(x_s, y_s) = \begin{cases} \text{if } \neg \text{ mirrored} & R\begin{bmatrix} x \\ y \end{bmatrix} \\ \text{if mirrored} & R\begin{bmatrix} -x \\ y \end{bmatrix} \end{cases}$$

This will be explained in further detail below.

Figure 6:
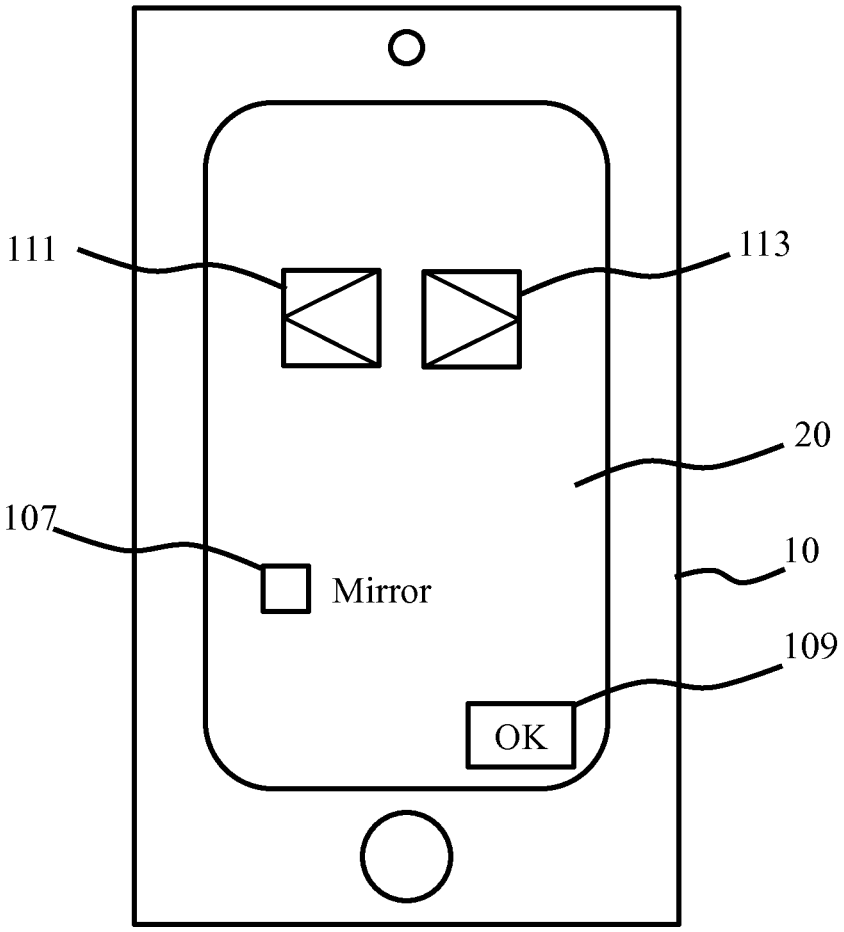
FIG. 6 schematically depicts another example of a user interface for establishing the relative orientation of the user interface device according to an embodiment.
Figure 7:
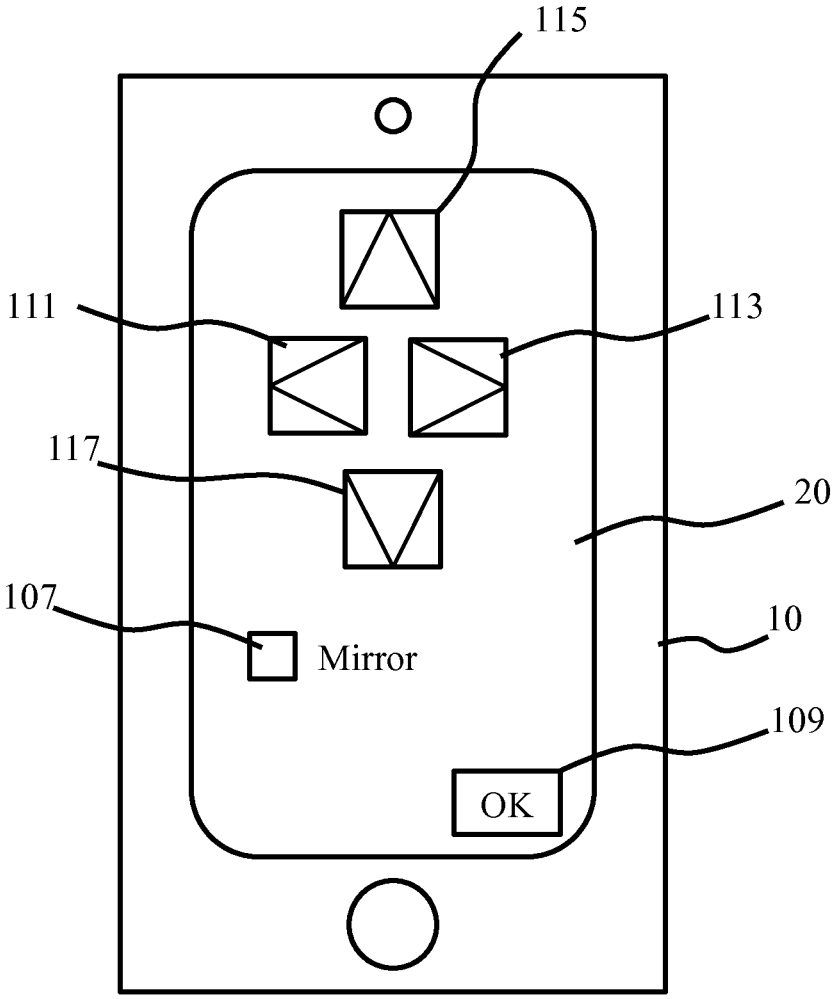
FIG. 7 schematically depicts another example of a user interface for establishing the relative orientation of the user interface device according to an embodiment.

It should be understood that the user interface controls allowing a user to specify the reference rotation of the light output 60 may take any suitable shape. For example, in FIG. 6 the dial 101 has been replaced with a first button 111 facilitating a counter-clockwise reference rotation and a second button 113 facilitating a clockwise reference rotation. In this embodiment, the processor 14 may determine the angle α from the duration of the respective engagements of the first button 111 and the second button 113, i.e. how long the user engaged these buttons. As schematically shown in FIG. 7, yet another example embodiment includes a third button 115 and a fourth button 117, in which buttons 111, 113, 115 and 117 may be used to direct light output 60 in the directions corresponding to icons on these buttons, e.g. left, right, up and down.

Figure 8:
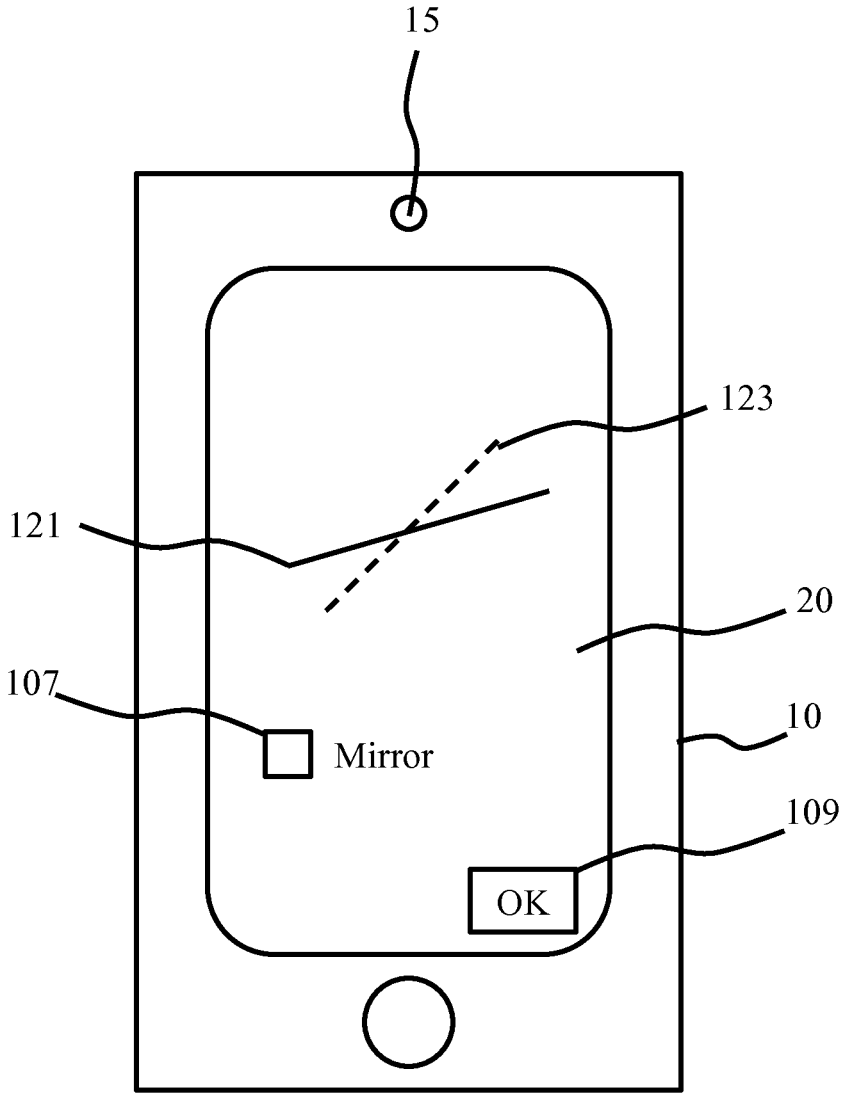
FIG. 8 schematically depicts an example of a user interface for establishing the relative orientation of the user interface device according to another embodiment.

FIG. 8 schematically depicts yet another example embodiment in which the user may indicate a translation direction of the light output 60 by swiping or otherwise controlling the user interface 20, as indicated by the solid line 121 and by subsequently indicating the perceived translation direction of the light output 60 as invoked by the luminaire 50 on the user interface 20, e.g. by swiping or otherwise controlling the user interface 20, as indicated by the dashed line 123. In this embodiment, the processor 14 may calculate the rotation angle $\alpha$ from the angle between the user-specified reference direction of the light output translation indicated by the solid line 121 and the user-specified perceived light output translation direction indicated by the dashed line 123. In this embodiment, the tick box 107 may be omitted; instead, the processor 14 may determine from the swipe direction indicated by the solid line 121 and the swipe direction indicated by the dashed line 123 whether such a mirroring axis is present, thereby obviating the need for the user to explicitly indicate this presence.

In an alternative embodiment, the user interface device 10 may be adapted to capture the perceived actual light output translation direction as implemented by the luminaire 50 in response to the reference instructions provided by the user as indicated by solid line 121 with the camera 15. In this embodiment, the user should aim the camera 15 at the surface onto which the light output 60 is projected in order to capture the perceived actual light output translation direction as implemented by the luminaire 50, such that the processor 14 can extract this perceived actual direction from a series of still images or video images captured by the camera 15. Such optical luminaire response capturing a further advantage that any unintentional movement of the user interface device 10 by the user during capturing of the luminaire response may be corrected for, as such movement will be apparent from the images captured by the camera 15, such that the processor 14 may identify this movement using well-known image processing algorithms and construct the transformation matrix by also applying a correction factor for this movement.

In yet another alternative embodiment, the user may specify the reference light output translation direction by moving the user interface device 10 in this direction. For example, the user interface 20 may present a hold button or the like, which is held by the user during the movement of the user interface device 10 in the reference direction and released upon completion of this movement, after which the perceived actual direction of the spotlight movement as implemented by the luminaire 50 in response to this reference instruction may be captured with the camera 15 and processed by the processor 14 as previously explained.

Figure 9:
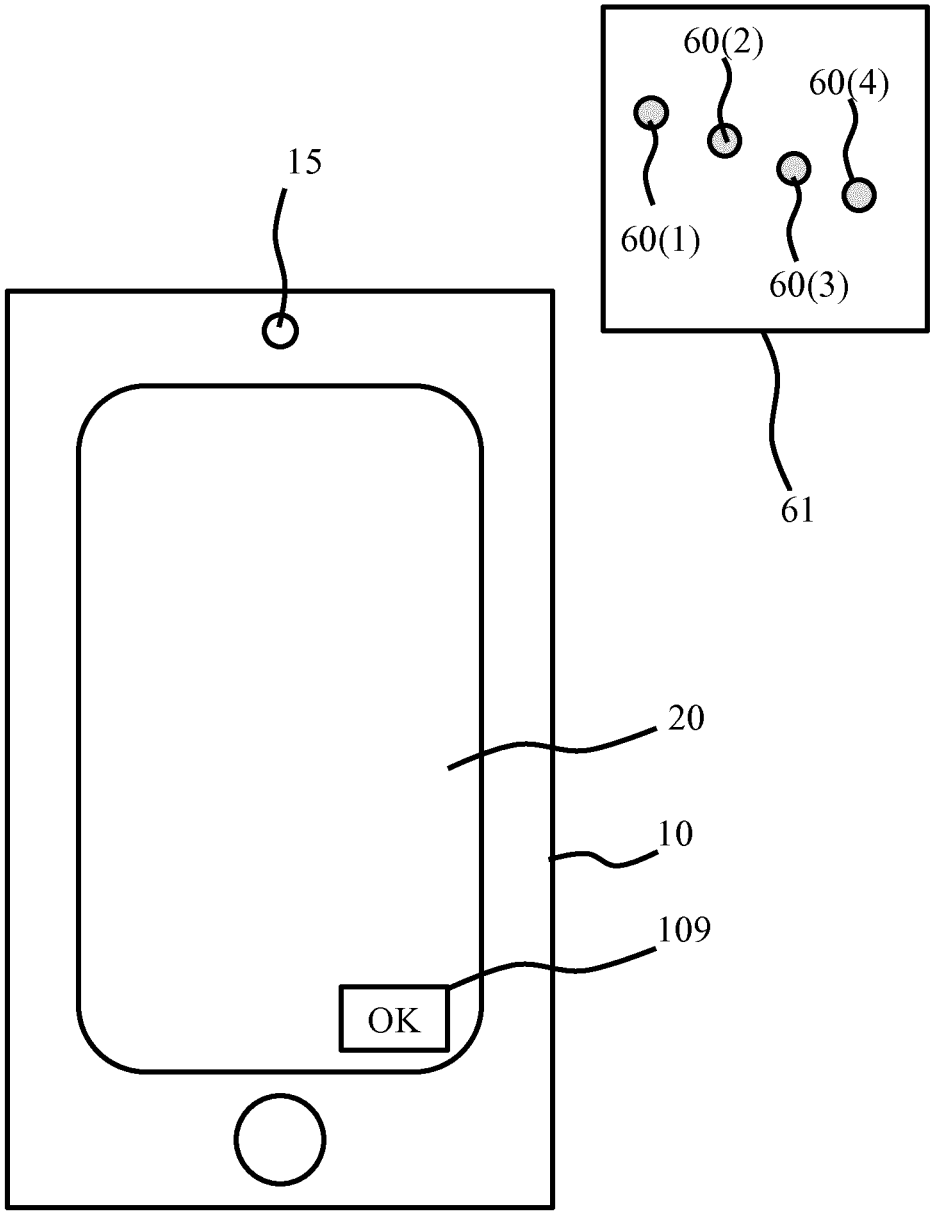
FIG. 9 schematically depicts an example of a user interface for establishing the relative orientation of the user interface device according to yet another embodiment.

FIG. 9 schematically depicts yet another example embodiment of a method of capturing the relative orientation of the user interface device 10. In this embodiment, the user interface device 10 may trigger the luminaire 50 to generate a series of light outputs, e.g. light spots, (four light outputs 60(1)-60(4) are shown by way of non-limiting example only) in a predetermined direction, with the camera 15 capturing the perceived actual direction in which this series of light outputs is generated in order to determine the relevant parameters for the construction of the transformation matrix as explained in more detail above. This embodiment has the advantage that the reference instruction for the luminaire 50 may be generated and the luminaire response thereto may be captured by the user interface device 10 in a fully automated fashion such that the user only has to invoke the calibration procedure and aim the camera 15 at the surface onto which the light outputs are projected. The light outputs 60(1)-60(4) may be separate to the light output 60 or alternatively at least one of the light outputs 60(1)-60(4) is the light output 60, such as the initial light output generated by the luminaire 50 in the series of light outputs.

It should be understood that the above examples of procedures to determine the relative orientation of the user interface device 10 in respect of the luminaire 50 are shown by way of non-limiting example only, and that the skilled person will have no difficulty to come up with many more examples based on the above teachings.

Upon construction of the transformation matrix in 211 with the processor 14 based on the relevant parameters as derived from the relative orientation determination of the user interface device 10 in respect of the luminaire 50 as explained above, methods 200 and 300 may proceed to 219 in which a user may specify a desired light output positioning instruction on the user interface 20, which light output positioning instruction is transformed by the processor 14 in 221 using the transformation matrix constructed in 211. The transformed instruction is subsequently transmitted to the luminaire 50 by the wireless communication module 12 and received by the wireless communication module 52 associated with the luminaire 50, such that the controller 54 of the luminaire 50 can adjust the position of, or generate, the light output 60 in accordance with the received transformed instruction. In this manner, a user should perceive the (re)positioning or translation of the light output 60 in an orientation (in case of generation of a light output 60) or in a direction (in case of repositioning of the light output 60) corresponding to the (re)orientation, e.g. direction, indicated on the user interface 20, thereby providing an intuitive user experience.

However, if for whatever reason the relative orientation of the user interface device 10 has changed in between its calibration, i.e. the determination of its relative orientation in respect of the luminaire 50, the user may observe a discrepancy between the specified orientation in which the light output 60 should have been generated or repositioned and the actual orientation or location in which the light output was positioned by the luminaire 50. This may be undesirable if it does not lead to the desired intuitive control of the light output 60. In an embodiment, it may be checked in 225 whether such a discrepancy has been detected, e.g. by a user providing an indication thereof on the user interface 20. In the case of such a discrepancy, methods 200 and 300 may revert back to the calibration process, e.g. revert back to 203 or 303 to re-establish the actual relative orientation of the user interface device 10 in respect of the luminaire 50. Alternatively, the light positioning instruction provided by the user in 219 may be used as the reference instruction in 303, such that method 300 may revert back to 305 instead in which for example the user may indicate the perceived direction in which the luminaire 50 has repositioned the light output 60 in order to determine an up-to-date rotation angle between the specified direction and the perceived direction for calculating a new transformation matrix as previously explained.

In an embodiment in which the user interface device 10 comprises one or more orientation sensors 18 for detecting the orientation of the user interface device 10, the user interface device 10 may determine its actual orientation together with its relative orientation in respect of the luminaire 50 and store the actual orientation associated with a particular relative orientation, e.g. associated with a particular transformation matrix, in the data storage device 16. In this embodiment, the user interface device 10 may be adapted to continuously or periodically check its actual orientation and compare it with a historic orientation associated with the particular relative orientation as stored in the data storage device 16. If a discrepancy between its actual orientation and the retrieved historic orientation is determined, i.e. the orientation of the user interface device 10 has changed, the processor 14 may update its transformation matrix based on the difference between the actual orientation and the retrieved historic orientation (i.e. the previously assumed actual orientation). In this manner, the transformation matrix used to transform a user-defined light output positioning instruction is received in 219 is always accurate, thereby ensuring the desired intuitive light output control with the user interface device 10. Upon updating the transformation matrix in this manner, the new actual orientation of the user interface device 10 may be stored in the data storage device 16, e.g. may replace the previously retrieved historic orientation, and may be associated with the updated relative orientation of the user interface device 10 in respect of the luminaire 50, e.g. may be associated with the updated transformation matrix.

The user may continue to (re)orient, e.g. readjust, the position of the light output 60 until it is decided in 227 that such readjustment has been completed, after which methods 200 and 300 may terminate in 229.

In a further embodiment, methods 200 and 300 may include operation 213 in which a distance between the user interface device 10 and the luminaire 50 is determined. Such a distance determination may be performed in any suitable manner. For example, the user interface device 10 and the luminaire 50 may include positioning systems, e.g. GPS systems, with the distance being calculated from the respective positions provided by these positioning systems. Alternatively, the luminaire 50 may be adapted to send a distance determination signal to the user interface device 10, with the user interface device 10 arranged to calculate the distance from the strength or the time of flight of the received signal. In a particularly preferred embodiment, the luminaire 50 provides the user interface device 10 with size information for the light output 60, with the user interface device 10 arranged to capture an image of the light output 60 with the camera 15 and derive a distance to the light output 60 from the received size information and the size of the light output 60 captured with the camera 15.

Such distance information for example is useful to adjust the granularity of the user instruction received in 219. In this context, the term granularity may indicate the distance across which the luminaire 50 displaces the light output 60 in response to a distance indicated by the user on the user interface 20, e.g. the length of a swipe or the like. Such a granularity adjustment may be desirable to maintain a high degree of intuition in controlling the position of the light output 60 with the user interface device 10. For instance, a user in close proximity to the light output 60 may wish to indicate a certain (re)positioning of the light output 60 with a relatively large swipe, whereas a user further away from the light output 60 may wish to indicate the same (re) positioning of the light output with a smaller swipe because the perceived distance over which the light output 60 has to travel appears smaller at larger distances from the surface onto which the light output 60 is projected. The distance information obtained in 213 may be used in 217 as a scaling factor in addition to the transformation matrix in order to scale the distance information in the spot adjustment such that the luminaire 50 translates the light output 60 over the distance as intended by the user in his or her current location relative to the luminaire 50 or light output 60.

Similarly, if the luminaire 50 projects a light output 60 under a certain tilt angle, e.g. a ceiling or floor mounted luminaire projecting the light output 60 onto a wall under such a tilt angle, an instruction provided by the user in 219 to translate light output 60 over a certain distance in which the tilt angle is increased may lead to a different actual translation difference of the light output 60 is invoked by the luminaire 50 compared to a user instruction provided in 219 in which the user specifies a translation of the light output 60 over the same distance but in which the tilt angle is decreased. To this end, the user may be asked in 215 to actuate a calibration in which the light output 60 is moved from its original position in the number of different directions, e.g. up, down, left and right, by the same distance. The actual displacement distance may be determined or estimated by capturing the light output movement invoked by the luminaire 50 in response to the calibration instruction with the camera 15. In this manner, a direction-dependent scaling factor as a function of the determined tilt angle may be determined, e.g. by determining the ratio between the specified displacement distance and the perceived displacement distance of the light output 60 and basing the scaling factor on the inverse of this ratio. This scaling factor may be used to scale the light output translation distance indicated in the user instruction provided in 219 such that the light output 60 is translated according to distance specified by the user by applying this scaling factor to the distance information in this user-specified light output repositioning instruction.

This embodiment may be expanded by determining a scaling factor for the size of the light output 60, e.g. by quantifying an observed change in the size in response to the aforementioned user calibration instruction(s), and by including a light output rescaling instruction in the light output repositioning instruction transmitted to the luminaire 50 in 223, which light output rescaling instruction can trigger the luminaire 50 to resize the light output 60 such that the overall size of the light output 60 remains constant during the (re)positioning of the light output 60 in accordance with the received light output positioning instruction from the user interface device 10.

In the above embodiments, the luminaire 50 is controlled by the user interface device 10 by transmitting the transformed instruction to the luminaire 50, thereby facilitating the luminaire 50 to execute the transformed light out control instruction. However, it should be understood that at least some of the steps of methods 200 and 300 may alternatively be executed on a processor, e.g. controller 54 of the luminaire 50. For example, the user interface device 10 alternatively may be adapted to transmit its orientation information or a determined transformation matrix to the luminaire 50, which luminaire 50 may locally store the received user interface device orientation information or the determined transformation matrix to facilitate the calculation of the transformation matrix and/or the instruction transformation using the transformation matrix on the luminaire 50 instead.

In the above embodiments, the light output positioning instruction may be a light output redirection instruction received on the user interface 20 of the user interface device, which light output redirection instruction may include directional information for adjusting the light output 60 in a specified direction. However, embodiments of the present invention are not limited to repositioning an existing light output 60 in a user-specified new location. In some embodiments, the light output positioning instruction may allow a user of the user interface device 10 to specify any desirable light output 60, e.g. having a user-specified shape, image or pattern of shapes or images in a particular orientation, and render the user-specified light output 60 with the luminaire 50 using the above described transformation matrix, e.g. by reorienting the user-specified light output 60 with the transformation matrix and controlling the luminaire 50 in accordance with the transformed user positioning instruction, e.g. by rotating and/or translating the user-specified light output 60 in accordance with the transformed user positioning instruction. In this manner, a user of the user interface device 10 may obtain intuitive control over the light output 60, i.e. the orientation of the light output 60 on the user interface device 10 corresponds with the orientation of the light output 60 rendered with the luminaire 50.

Aspects of the present invention may be embodied as a computer-implemented luminaire control method 200, 300, a user interface device 10 and a lighting arrangement 1. Aspects of the present invention may take the form of a computer program product embodied in one or more computer-readable medium(s) having computer readable program code embodied thereon. The code typically embodies computer-readable program instructions for, when executed on a processor 14 of such a user interface device 10, implementing the luminaire control method 200, 300.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Such a system, apparatus or device may be accessible over any suitable network connection; for instance, the system, apparatus or device may be accessible over a network for retrieval of the computer readable program code over the network. Such a network may for instance be the Internet, a mobile communications network or the like. More specific examples (a non-exhaustive list) of the computer readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of the present application, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out the methods of the present invention by execution on the processor 14 may be written in any combination of one or more programming languages, including an object oriented programming language such as Java, Smalltalk, C++ or the like and conventional procedural programming languages, such as the "C" programming language or similar programming languages. The program code may execute entirely on the processor 14 as a stand-alone software package, e.g. an app, or may be executed partly on the processor 14 and partly on a remote server. In the latter scenario, the remote server may be connected to the user interface device 10 through any type of network, including a local area network (LAN) or a wide area network (WAN), or the connection may be made to an external computer, e.g. through the Internet using an Internet Service Provider.

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions to be executed in whole or in part on the processor 14 of the user interface device 10, such that the instructions create means for implementing the functions/acts specified in the flowchart and/or block diagram block or blocks. These computer program instructions may also be stored in a computer-readable medium that can direct the user interface device 10 to function in a particular manner.

The computer program instructions may be loaded onto the processor 14 to cause a series of operational steps to be performed on the processor 14, to produce a computer-implemented process such that the instructions which execute on the processor 14 provide processes for implementing the functions/acts specified in the flowchart and/or block diagram block or blocks. The computer program product may form part of the user interface device 10, e.g. may be installed on the user interface device 10.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method of controlling a luminaire adapted to generate a light output in a controllable direction with a user interface device, the method comprising:

determining a relative orientation of the user interface device to the luminaire by determining a rotation angle of the user interface device relative to the luminaire and determining whether a mirroring axis exists between the user interface device and the luminaire, wherein the rotation angle is determined by at least one of a user input and a sensor input;

receiving a light output positioning instruction on a user interface of the user interface device, said light output positioning instruction including directional information for the positioning of the light output in a specified location;

converting the light output positioning instruction by transforming the directional information based on the determined relative orientation; and controlling the luminaire with the converted light output positioning instruction; and wherein the directional information is transformed based on the determined rotation angle and mirroring axis if existing.

2. The method of claim 1, wherein determining the existence of a mirroring axis between the user interface device and the luminaire comprises receiving an indication of said existence on the user interface.

3. The method of claim 1, further comprising receiving luminaire orientation information from the luminaire, wherein determining a relative orientation of the user interface device to the luminaire is at least partially based on the received luminaire orientation information.

4. The method of claim 1, further comprising determining a user interface device orientation, wherein determining a relative orientation of the user interface device to the luminaire is at least partially based on the determined user interface device orientation.

5. The method of claim 4, wherein determining a relative orientation of the user interface device to the luminaire is at least partially based on an initially determined user interface device orientation, the method further comprising:

monitoring the user interface device orientation; and updating the relative orientation based on a monitored change to the initially determined user interface device orientation.

6. The method of claim 1, wherein determining a relative orientation of the user interface device to the luminaire comprises:

instructing the luminaire to redirect the light output in a reference direction;

capturing an observation direction of the light output redirection with the user interface device; and determining the relative orientation of the user interface device to the luminaire from a difference between the reference direction and the observation direction.

7. The method of claim 6, wherein instructing the luminaire to redirect the light output in a reference direction comprises receiving the reference direction on the user interface.

8. The method of claim 6, wherein instructing the luminaire to redirect the light output in a reference direction comprises instructing the luminaire to generate a series of light outputs in different locations in said reference direction.

9. The method of claim 6, wherein capturing an observation direction of the light output redirection with the user interface device comprises:

receiving an indication of the observation direction on the user interface; or capturing the observation direction with a camera integral to the user interface device.

10. The method of claim 1, further comprising determining a distance between the user interface device and the luminaire, wherein converting the light output positioning instruction further comprises scaling the directional information based on the determined distance.

11. The method of claim 1, further comprising determining a tilt angle of the luminaire relative to a surface onto which the light output is projected, wherein converting the light output positioning instruction further comprises scaling the directional information based on the determined tilt angle.

12. A computer program product comprising a computer readable storage medium having computer readable program instructions embodied therewith for, when executed on a processor of a user interface device for controlling a luminaire adapted to generate a light output in a controllable direction, cause the processor to implement the following:

determine a relative orientation of the user interface device to the luminaire by determining a rotation angle of the user interface device relative to the luminaire and determining whether a mirroring axis exists between the user interface device and the luminaire;

receive a light output positioning instruction on a user interface of the user interface device, said light output positioning instruction including directional information for the positioning of the light output in a specified location;

convert the light output positioning instruction by transforming the directional information based on the determined relative orientation; and control the luminaire with the converted light output positioning instruction.

13. An illumination system comprising:

a user interface device for controlling a luminaire adapted to generate a light output in a controllable direction, the user interface device comprising a processor, a user interface;

a data storage device embodying a computer program product;

a wireless communication module;

wherein the processor is communicatively coupled to the user interface, the data storage device and the wireless communication module, and wherein the processor is adapted to execute the computer readable program instructions of the computer program product and to send a converted light output positioning instruction received on the user interface to the luminaire with the wireless communication module; and wherein the computer program product computer readable program instructions that when executed cause the processor to perform the following:

determine a relative orientation of the user interface device to the luminaire by determining a rotation angle of the user interface device relative to the luminaire and determining whether a mirroring axis exists between the user interface device and the luminaire;

receive a light output positioning instruction on a user interface of the user interface device, said light output positioning instruction including directional information for the positioning of the light output in a specified location;

convert the light output positioning instruction by transforming the directional information based on the determined relative orientation; and control the luminaire with the converted light output positioning instruction.

14. The illumination system of claim 13, further comprising a luminaire arrangement including the luminaire adapted to generate a light output in a controllable direction, a controller for controlling the luminaire and a further wireless communication module adapted to receive a light output positioning instruction from the user interface and communicate the received light output positioning instruction to the controller.

* * * * *